US005987860A

United States Patent [19]

Yang

[11] Patent Number: 5,987,860

[45] Date of Patent: Nov. 23, 1999

[54] GUIDING PLATE FOR A WRAPPING DEVICE

[76] Inventor: Terry Yang, 5th Fl., No. 360, Sec. 6, Chungshan N. Rd., Taipei, Taiwan

[21] Appl. No.: 09/111,619

[22] Filed: Jul. 7, 1998

[51] Int. Cl.[6] ..... B65B 9/06

[52] U.S. Cl. ..... 53/550; 53/578; 493/302; 493/476

[58] Field of Search ..... 53/550, 578; 493/302, 493/475, 476, 478

[56] References Cited

U.S. PATENT DOCUMENTS

| | | | |
|---|---|---|---|
| 3,340,669 | 9/1967 | Farquharson . | |
| 3,739,545 | 6/1973 | Lattke . | |
| 4,267,684 | 5/1981 | Ambrose . | |
| 4,519,185 | 5/1985 | Horn et al. | 53/550 |
| 4,653,251 | 3/1987 | Ambrose . | |
| 4,662,148 | 5/1987 | Nilsson . | |
| 4,918,904 | 4/1990 | Pharo . | |
| 5,129,512 | 7/1992 | Garwood . | |
| 5,133,173 | 7/1992 | Draghetti et al. . | |
| 5,272,856 | 12/1993 | Pharo . | |
| 5,435,115 | 7/1995 | Simmons | 53/550 |
| 5,713,185 | 2/1998 | Lindström et al. . | |
| 5,799,467 | 9/1998 | Nankervis et al. | 53/550 |

*Primary Examiner*—John Sipos
*Attorney, Agent, or Firm*—Kolisch Hartwell Dickinson McCormack & Heuser

[57] ABSTRACT

Two spaced guiding plates for a wrapping device each have a first inclined face formed thereon and each of which faces the other, therefore, a V-shaped space is defined therebetween. An adjusting plate is securely mounted on a side of the wrapping device and has a second inclined face formed thereon. The first inclined face and the second inclined face are in line with each other, such that edges of a sheet of material for wrapping a article are able to be guided by the first inclined face and the second inclined face. With the help of the guiding plates and the adjusting plate, the present invention is able to precisely guide edges of the sheet of material and to efficiently wrap the article.

4 Claims, 5 Drawing Sheets

GUIDING PLATE FOR A WRAPPING DEVICE

BACKGROUND OF THE INVENTION

1. Field of the Invention

The present invention relates to a guiding plate, and more particularly to a guiding plate for a wrapping device, which guides a sheet of wrapping material smoothly and enables a wrapping device to wrap a product or package precisely according to the size of the product or the package.

2. Background

Packing devices and wrapping devices are used all over the world in automated systems, especially in factories. Notwithstanding the differences between different devices, one thing that a packing device or a wrapping device does not include is a material used to wrap products. The material is used to wrap the product entirely to protect the product from contamination from the environment and to maintain the quality thereof. It is therefore noted that the wrapping device or the packing device does have the function of wrapping the product. But, a conventional wrapping device can not meet the needs of users, which is able to be adapted to the different sizes and/or dimensions of products. Furthermore, conventional wrapping devices still suffer from another disadvantage, that is, the wrapping material often have wrinkles, which causes a degradation in the appearance of the product. It is appreciated from the operation of a conventional wrapping device that alteration and/or modification thereof is required to facilitate smooth operation of the wrapping procedure and to be adapted to the dimensions of different products.

The present invention provides an improved guiding plate for a wrapping device to obviate and/or mitigate the aforementioned problems.

SUMMARY OF THE INVENTION

The primary object of the invention is to provide an improved guiding plate for a wrapping device, which is able to smoothly guide a sheet of material used to wrap a product in a predetermined path so as to evenly wrap the product.

Another object of the invention is to provide a pair of adjustable seats oppositely disposed on the wrapping device and each having a support extending out therefrom, such that the wrapping device is able to be adapted to different dimensions according to the size of products.

Other novel features and advantages of the invention will become more apparent from the following detailed description when taken in conjunction with the accompanying drawings.

DETAILED DESCRIPTION OF THE PREFERRED EMBODIMENT

Figure 1:
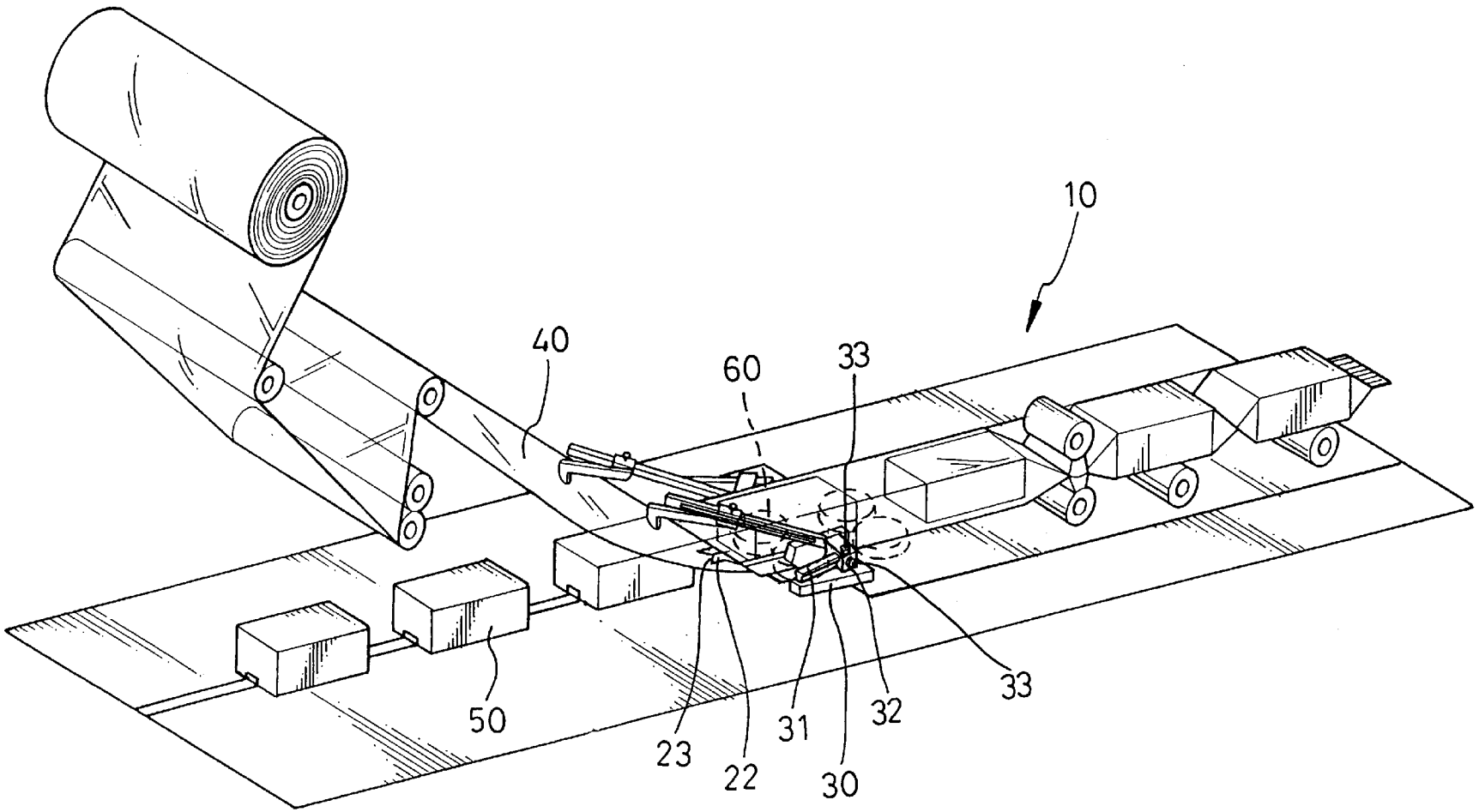
FIG. 1 is a schematic perspective view of an embodiment of a guiding plate mounted onto a wrapping device of the present invention.
Figure 2:
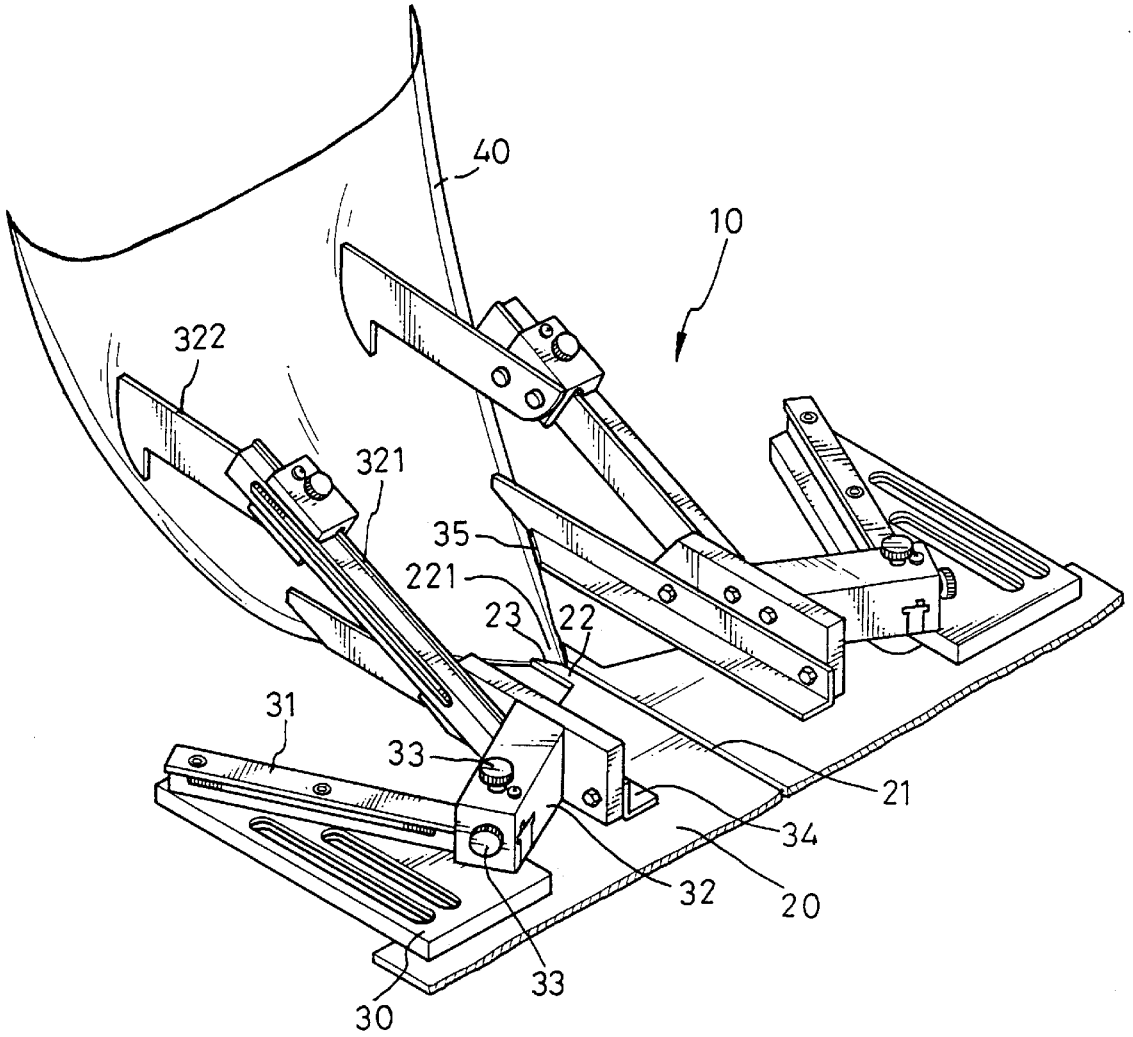
FIG. 2 is a partially perspective view of the detailed structure of a portion of the wrapping device.

Referring to FIGS. 1 and 2, it is noted that a wrapping device 10 constructed in accordance with the present invention is shown. The wrapping device 10 comprises a pair of opposite guiding plates 20 securely mounted thereon and each having a guide 22 formed thereon and adjacent to each other, a pair of adjusting seats 30 securely and respectively mounted onto each one of the guiding plate 20, means for providing a sheet of material 40 to the wrapping device 10 in order to wrap articles 50 placed on the means for transporting the articles 50. The guide 22 of each of the guiding plates 20 has a first inclined face 23. Each of the first inclined faces 23 of the two guiding plates 20 are facing each other, such that a V-shaped space 221 is defined between two guides 22. The adjusting seat 30 has a first arm 31 securely mounted thereon, a block 32 slidably connected with the first arm 31, a support 321 securely connected with the block 32 and an extension 322 slidably connected with the support 321. The block 32 is slidably connected with the first arm 31 via the control of a plurality of adjusting knobs 33 on the block 32 and the extension 322 is slidably connected with the support 321 also via the control of a plurality of adjusting knobs 33 on the extension 322, such that the wrapping device 10 of the invention is able to adjust its height and width via the respective sliding of the block 32 and the extension 322 on the first arm 31 and the support 321. Furthermore, means for moving and sealing the sheet of material 40 after the article 50 is wrapped is symmetrically provided under the pair of guiding plates 20, such that the sheet of material 40 will be continuously pulled by the moving and sealing means. Because the providing means for providing the sheet of material 40 to the wrapping device 10, the transporting means for transporting the articles 50 and the moving and sealing means for moving and sealing the sheet of material 40 after the articles 50 are wrapped are conventional in the art, detailed description thereof is not necessary.

Figure 3:
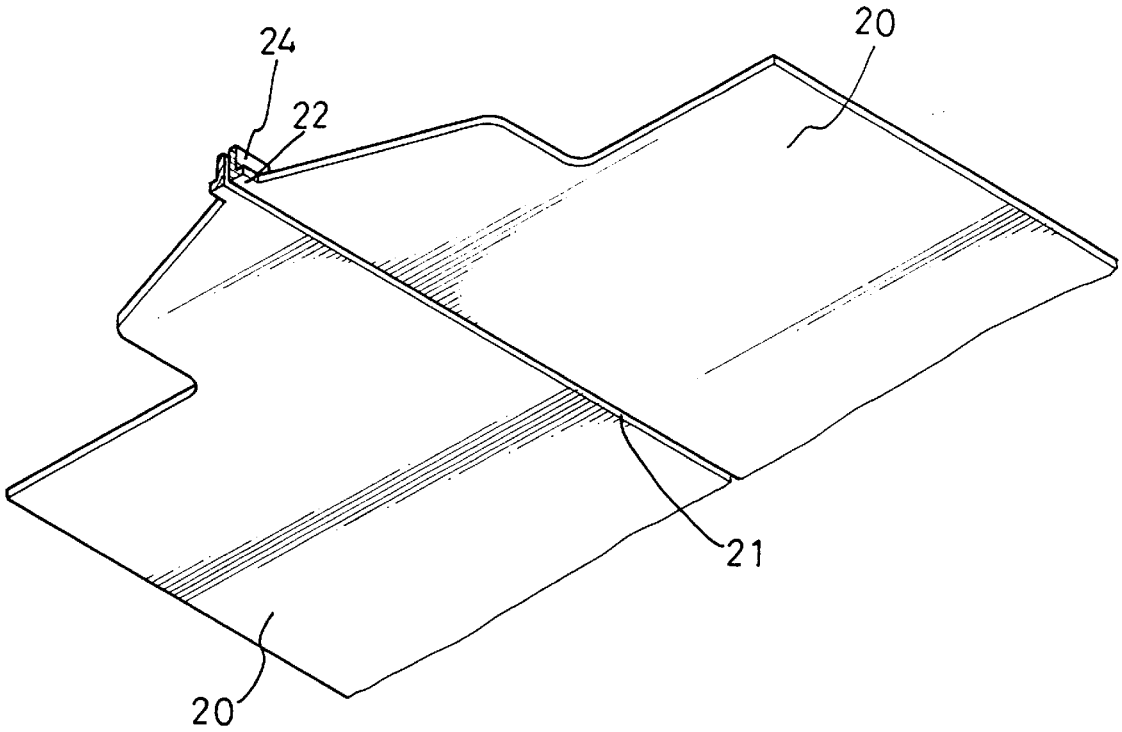
FIG. 3 is a bottom view of the guiding plate constructed in accordance with the present invention.

Referring to FIGS. 2 and 3, an adjusting plate 34 is fixedly mounted on a side of the block 32 and the adjusting plate 34 has a second inclined face 35 formed thereon. It is to be noted that the first inclined face 23 of the guiding plate 20 and the second inclined face 35 of the adjusting plate 34 are designed to be displaced horizontally so as that the transporting and sealing means is able to pull the sheet of material 40 along an imaginary line formed by the first inclined face 23 and the second inclined face 35. Furthermore, a gap 21 is defined between the two opposite guiding plates 20, therefore, the guided sheet of material 40 is further guided by the gap 21 between the two opposite guiding plates 20, so that the sheet of material 40 is able to be smoothly pulled by the transporting and sealing means.

Figure 4:
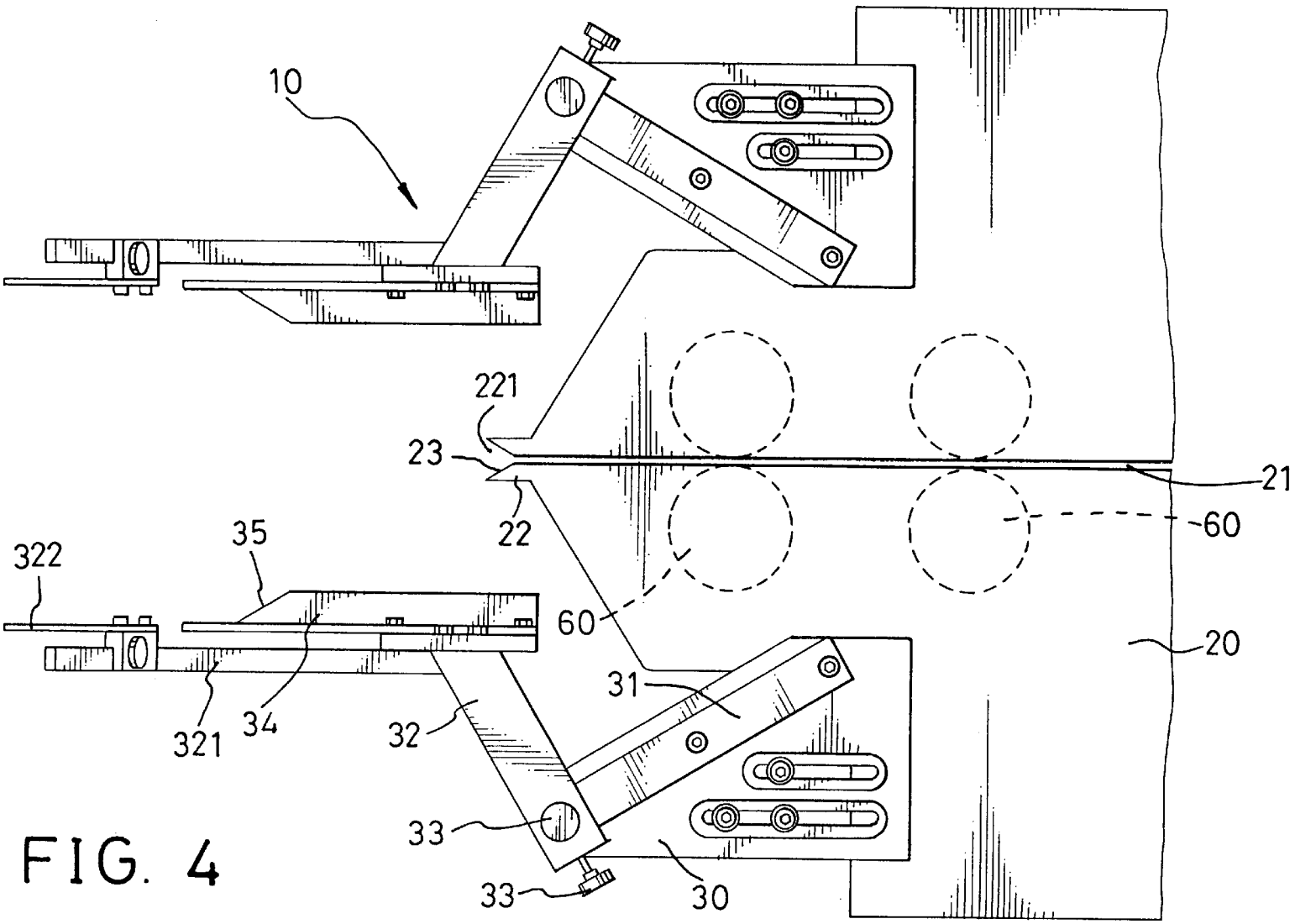
FIG. 4 is a partial top plan view of the wrapping device of the invention.
Figure 5:
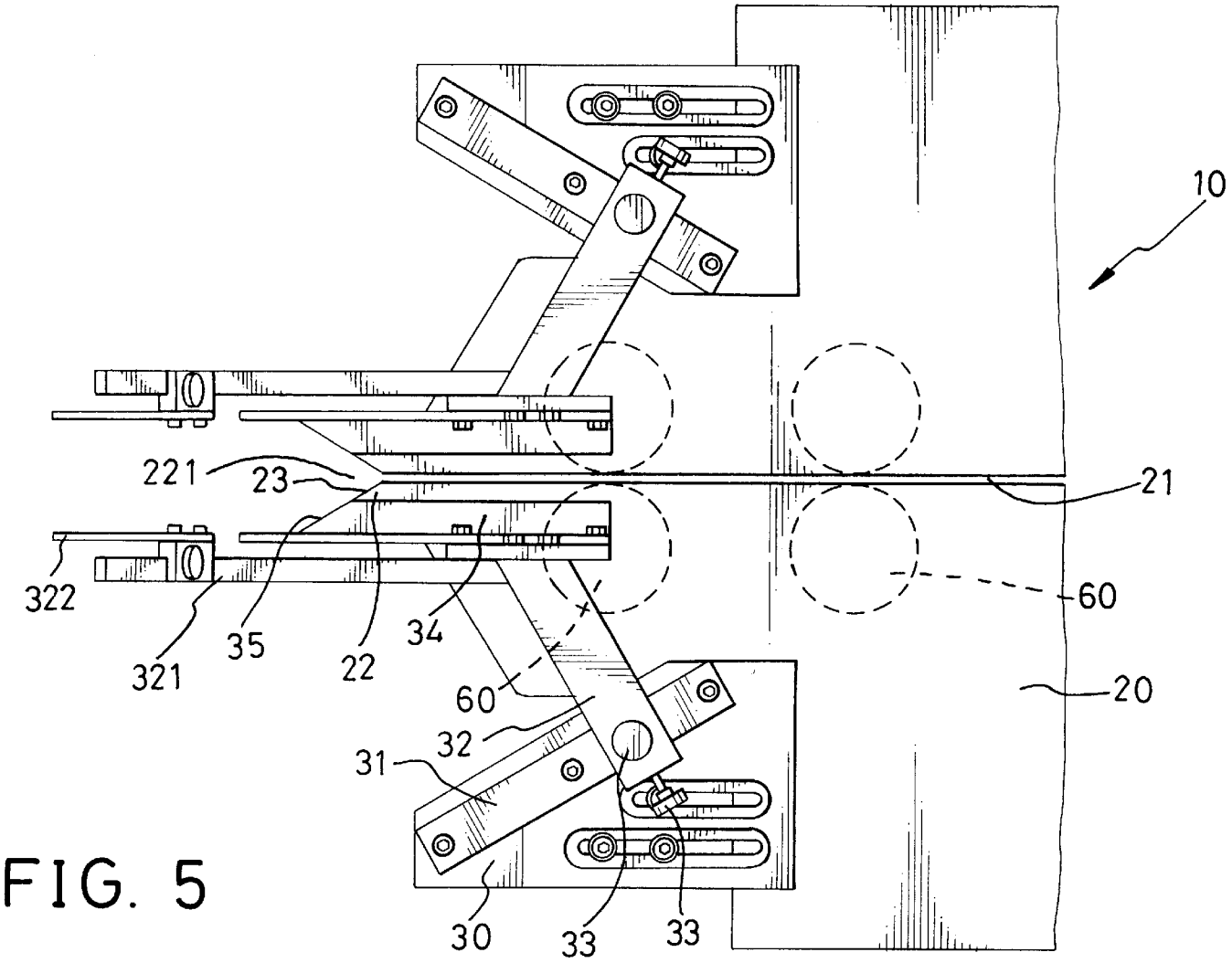
FIG. 5 is a top plan view showing an adjustment of supports in order to adapt to different dimensions of various products.

Referring to FIGS. 4 and 5, means for moving and sealing the sheet of material 40 has a reference numeral of 60 and is shown in phantom line, which means that the moving and sealing means 60 is provided under the pair of guiding plates 20. As described previously, the articles 50 to be wrapped have different dimensions, so that a user is able to loose the adjusting knobs 33 to move the block 32 along the first arm 31 to be adapted to different dimensions of the articles 50.

Figure 6:
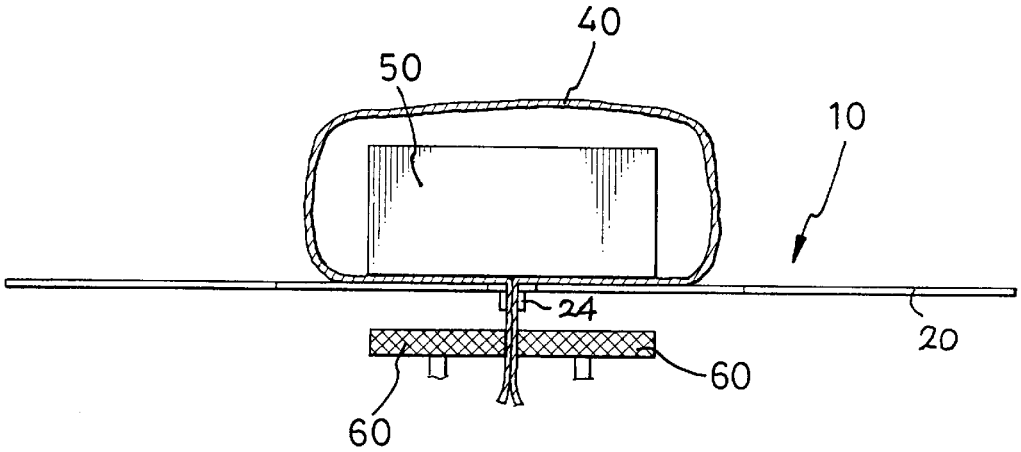
FIG. 6 is a schematic view showing a sealing of the sheet of material of the wrapping device.

FIG. 6 shows that when both sides of the sheet of material 40 for wrapping the articles are guided along the imaginary line formed by the first inclined face 23 and the second inclined face 35 and within the gap 21, the moving and sealing means 60 is able to continuously pull the sheet of material 40 and seal opposite edges (not numbered) of the sheet of material 40 and therefore wrap the article 50 within the sheet of material 40. Thereafter, with the help of cutting means for cutting the sheet of material 40 after the article 50 is enclosed within a portion of the sheet of material 40, and other sealing means, the article 50 is independently wrapped.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the fall extent indicated by the broad general meaning of the terms in which the appended claims are expressed.

What is claimed is:

1. A wrapping natural in wrapping device comprising:

means for providing a sheet of material to the wrapping device in a predetermined direction;

means for moving articles to the wrapping device;

a pair of spaced and opposite guiding plates securely mounted for a guiding material, the guiding plates being and each of the guiding plates having a first face inclined relative said direction for guiding the material inclined face;

two adjusting seats securely and respectively mounted on the guiding plates;

a first arm securely mounted onto one of the adjusting seats;

a block slidably mounted onto the first arm;

a support securely mounted onto the block;

an extension slidably mounted onto the support, and an adjusting plate securely mounted on a side of the block and having a second inclined face in line with the first inclined face of the guiding plate for further guiding the material.

2. The wrapping device as claimed in claim 1 further having a guide formed on each one of the guiding plates for guiding edges of the sheet of material.

3. The wrapping device as claimed in claim 1 further having a gap defined between the two opposite guiding plates for receiving and guiding the edges of the sheet of material.

4. The wrapping device as claimed in claim 1, wherein the first inclined faces of each of the two opposite guiding plates are facing each other such that a V-shaped space is defined therebetween.

* * * * *